US006540542B1

(12) United States Patent
Simmel

(10) Patent No.: US 6,540,542 B1
(45) Date of Patent: Apr. 1, 2003

(54) ELECTRICAL CONNECTOR WITH IMPROVED LATCH MEANS

(75) Inventor: George M. Simmel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/027,057

(22) Filed: Dec. 20, 2001

(51) Int. Cl.[7] ..... H01R 13/62
(52) U.S. Cl. ..... 439/352; 439/353
(58) Field of Search ..... 439/352, 353, 439/358, 357, 610, 607

(56) References Cited

U.S. PATENT DOCUMENTS 4,526,433 A * 7/1985 Tanaka
4,838,808 A * 6/1989 Fujiura ..... 439/357
5,011,424 A * 4/1991 Simmons ..... 439/352
5,449,298 A * 9/1995 Fetterolf, Sr. et al. ..... 439/352
5,569,047 A * 10/1996 Pauza et al. ..... 439/353
5,580,182 A * 12/1996 Lin ..... 403/325
5,660,558 A * 8/1997 Osanai et al. ..... 439/353
6,071,141 A * 6/2000 Semmeling et al. ..... 439/353
6,132,231 A * 10/2000 Suzuki ..... 439/352
6,250,944 B1 * 6/2001 Jones ..... 439/352
6,319,040 B1 * 11/2001 Chang ..... 439/352
6,346,002 B1 * 2/2002 Hsu et al. ..... 439/352
6,454,589 B1 * 9/2002 Yeh ..... 439/352

* cited by examiner

*Primary Examiner*—Gary Paumen
(74) *Attorney, Agent, or Firm*—Stephen Z. Weiss

(57) ABSTRACT

An electrical connector is provided for mating with a complementary connecting device in a mating direction. A non-conductive housing mounts a plurality of conductive terminals. The housing has a channel extending generally parallel to the mating direction with an opening to the channel at a forward mating end of the housing. A flexible latch arm is located in the channel and has a free end with a latch plate for latchingly engaging an appropriate latch of the complementary connecting device inserted into the opening of the channel. The latch arm and latch plate are located substantially entirely within the bounds of the channel. The latch plate is in a plane generally parallel to the mating direction and has side edges confined by opposite side walls of the housing.

22 Claims, 3 Drawing Sheets

ELECTRICAL CONNECTOR WITH IMPROVED LATCH MEANS

FIELD OF THE INVENTION

This invention generally relates to the art of electrical connectors and, particularly, to an improved latching system having protected latch arms.

BACKGROUND OF THE INVENTION

A typical electrical connector assembly includes a first connector for mating with a second connector or other complementary connecting device. For instance, a male or plug connector is mateable with a female or receptacle connector. The connectors typically have complementarily engageable conductive terminals which are placed in engagement when the two connectors are mated to form an electrical connection interface. In order to prevent a pair of connectors from becoming unmated, some sort of latching system often is provided between the connectors.

One type of latching system for electrical connectors includes a flexible latch arm on one of the connectors engageable with a complementary latch on the other connector to hold the connectors in their mated condition. A latch arm may have a latch hook, for instance, on a distal end of the arm. A problem with such latching systems is that the latch arm, latch hook or other latching projection has a tendency to catch or snag on extraneous objects ranging from a person's clothing to electrical wires surrounding the connector assembly. These problems are caused by the exposure of the latching device. In addition, because such latching devices typically extend outwardly of a connector housing, for instance, they are susceptible to damage during mating and unmating of the connectors. The present invention is directed to solving these problems by providing an improved latching system wherein the latch devices of the system are protected by the connector housing.

SUMMARY OF THE INVENTION

An object, therefore, of the invention is to provide a new and improved latching system for an electrical connector which is mateable with a complementary connecting device in a mating direction.

In the exemplary embodiment of the invention, an electrical connector includes a dielectric housing mounting a plurality of conductive terminals. The housing has a channel extending generally parallel to the mating direction of the connector. The channel has opposite side walls and an opening at a forward mating end of the housing. A flexible latch arm has a free end located in the channel. The free end has a latch plate for latchingly engaging an appropriate latch of the complementary connecting device inserted into the opening in the channel. The latch plate is in a plane generally parallel to the mating direction. The latch plate has side edges confined by the opposite side walls of the housing. Therefore, the flexible latch arm and latch plate can flex in a direction generally perpendicular to the plane of the latch plate, but the latch arm and latch plate are confined against movement in the plane of the latch plate.

In the preferred embodiment of the invention, the latch arm and latch plate or other latch portion is located substantially entirely within the bounds of the channel in the housing. This prevents the latch arm from catching or snagging on extraneous objects which could damage or break the arm.

According to one aspect of the invention, the latch arm and latch plate are independent of the housing and are fabricated of metal material. The latch arm is elongated and generally planar in a plane generally parallel to the mating direction and generally perpendicular to the plane of the latch plate. A latch aperture is provided in the latch plate for latching engagement by the latch of the complementary connecting device.

According to another aspect of the invention, a pair of the latch arms and respective latch plates are provided at opposite sides of the housing. The pair of latch arms and latch plates may be located outside opposite ends of an elongated array of the terminals in the housing.

According to a further aspect of the invention, a pair of the latch arms and latch plates are integral components of a common metal latching clip. The latching clip includes an integral electrical cable clamping portion at a rear terminating end of the housing. The latching clip also includes an integral actuating portion joining the pair of latch arms for moving the latch plates out of latching engagement with the latches of the complementary connecting device.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
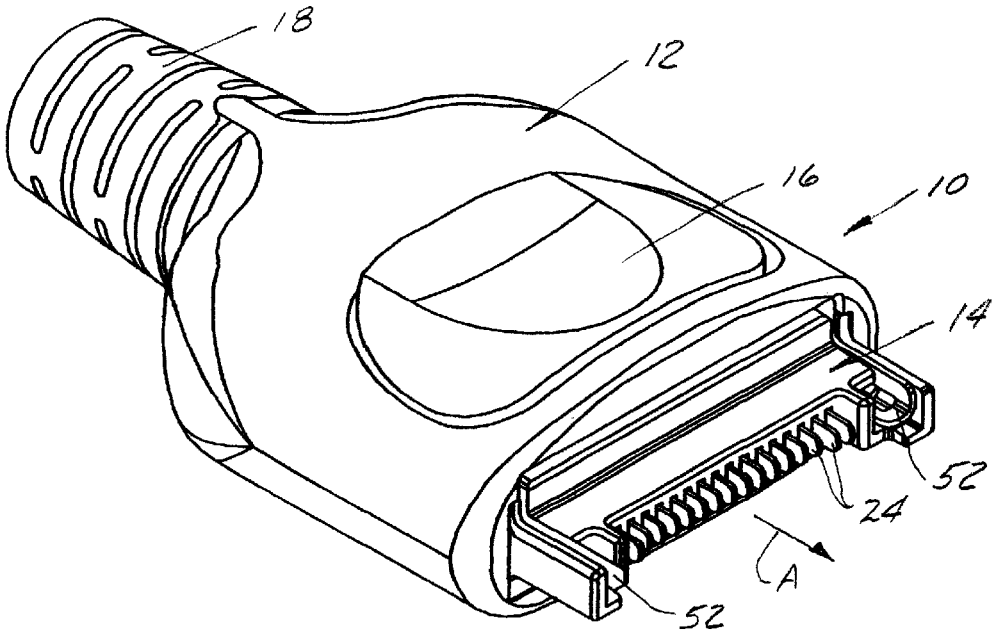
FIG. 1 is a perspective view of an electrical connector assembly embodying the concepts of the invention.
Figure 2:
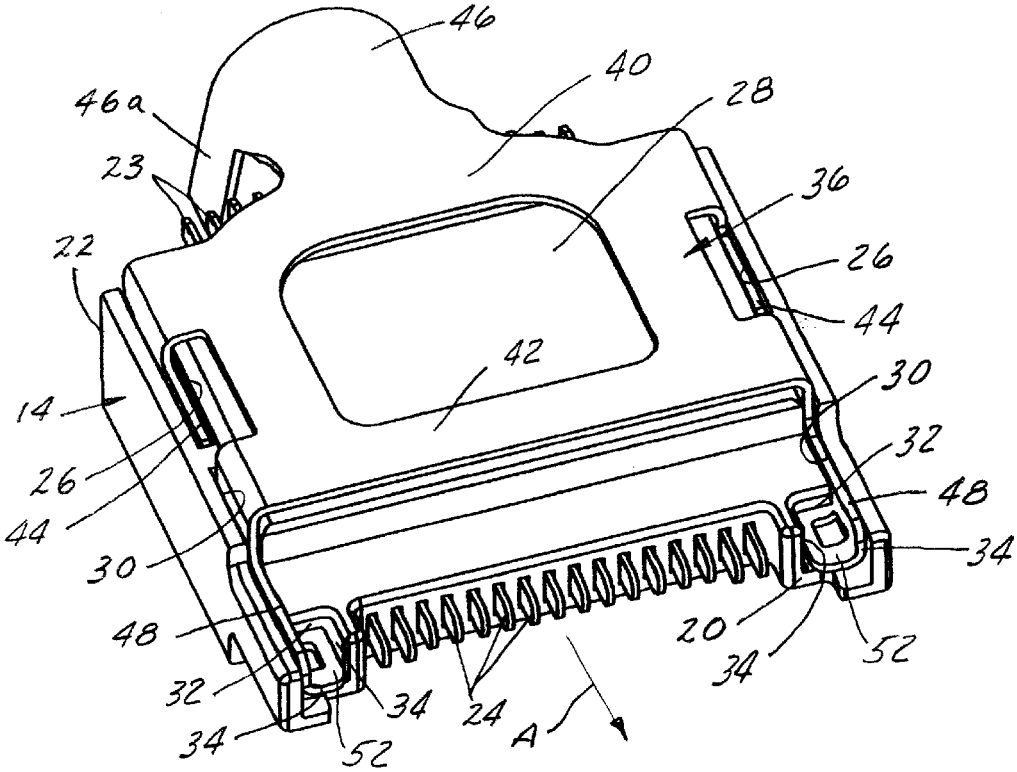
FIG. 2 is a perspective view of the connector assembly, with the outer housing removed.

Referring to the drawings in greater detail, and first to FIGS. 1 and 2, the invention is embodied in an electrical connector or connector assembly, generally designated 10 in FIG. 1. The assembly includes an outer housing, generally designated 12 (FIG. 1) and an inner housing, generally designated 14 and shown best in FIG. 2. Both the inner and outer housings are fabricated of a non-conductive dielectric material such as plastic or the like. However, inner housing 14 is fabricated of relatively hard plastic material, while outer housing 12 is fabricated of a more flexible plastic material so that it includes a depressible actuating button 16 (FIG. 1), along with a rear boot portion 18 which surrounds an electrical cable (not shown) which is terminated to the connector.

As best seen in FIG. 2, non-conductive dielectric inner housing 14 includes a forward mating end 20 and a rear terminating end 22. The housing and, therefore, connector 10 is mateable with a complementary connecting device or mating connector (described hereinafter) in a mating direction indicated by arrow "A". The housing mounts a plurality of terminals 23 which have forwardly projecting terminal blades 24 at the forward mating end of the housing. The terminals may be assembled into the housing from rear terminating end 22 thereof The housing includes a pair of rear channels 26 in a top surface 28 thereof near opposite sides of the housing. A pair of front channels 30 also are provided in the top of the housing closer to forward mating end 20 thereof In fact, front channels 30 have enlarged latching areas 32 which define openings at forward mating end 20 for receiving appropriate latches of the complementary mating connector as seen hereinafter. In essence, enlarged latching areas 32 define forward extensions of front channels 30 and are defined, in part, by opposite side walls 34. In the preferred embodiment of inner housing 14 shown in FIG. 2, rear channels 26 and front channels 30 are in-line with each other.

Figure 3:
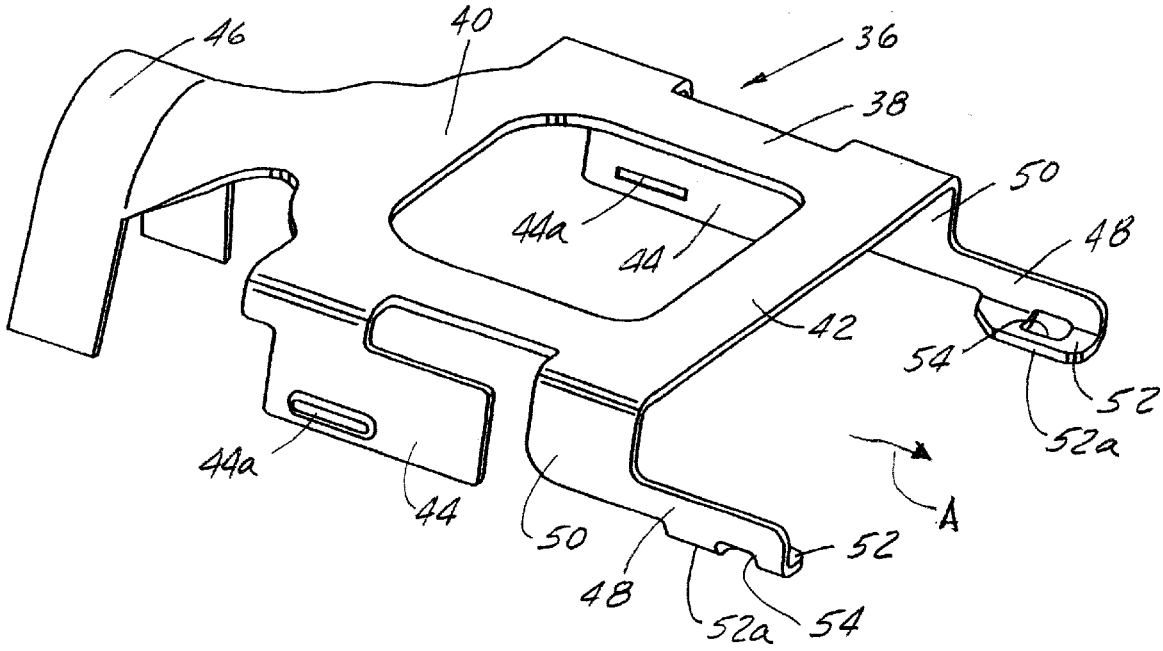
FIG. 3 is a perspective view of the one-piece latching clip of the assembly.

Referring to FIG. 3 in conjunction with FIG. 1, the connector assembly includes a one-piece latching clip, generally designated 36, which is stamped and formed of sheet metal material. The clip has a main flat body 38 which includes a rear cross portion 40 and a front cross portion 42. A pair of L-shaped mounting flanges 44 depend from opposite sides of rear cross portion 40. Each mounting flange is formed with one or more "raised" interference ribs 44*a*. An electrical cable clamping portion 46 projects rearwardly of rear cross portion 40 and includes a pair of bands 46*a* for clamping about an electrical cable (not shown) terminated to connector assembly 10. Actually, the cable would include a plurality of discrete electrical wires terminated to terminals 23.

Still referring to FIG. 3 in conjunction with FIG. 2, a pair of latch arms 48 project forwardly from a pair of locating flanges 50 which depend from opposite sides of front cross portion 42 of latching clip 36. A latch plate 52 is formed at a distal end of each latch arm 48. Each latch plate 52 has a latch aperture 54. In order to understand the structural orientation of latch arms 48 and latch plates 52, mating direction "A" which was described above in relation to FIGS. 1 and 2, is also shown by arrow "A" in FIG. 3. With that understanding, it can be seen that each latch arm 48 is generally planar (coplanar with locating flange 50) and extends generally parallel to mating direction "A". Each latch plate 52 also is generally planar, but the latch plate is in a plane which is generally perpendicular to the plane of its respective latch arm 48.

Figure 4:
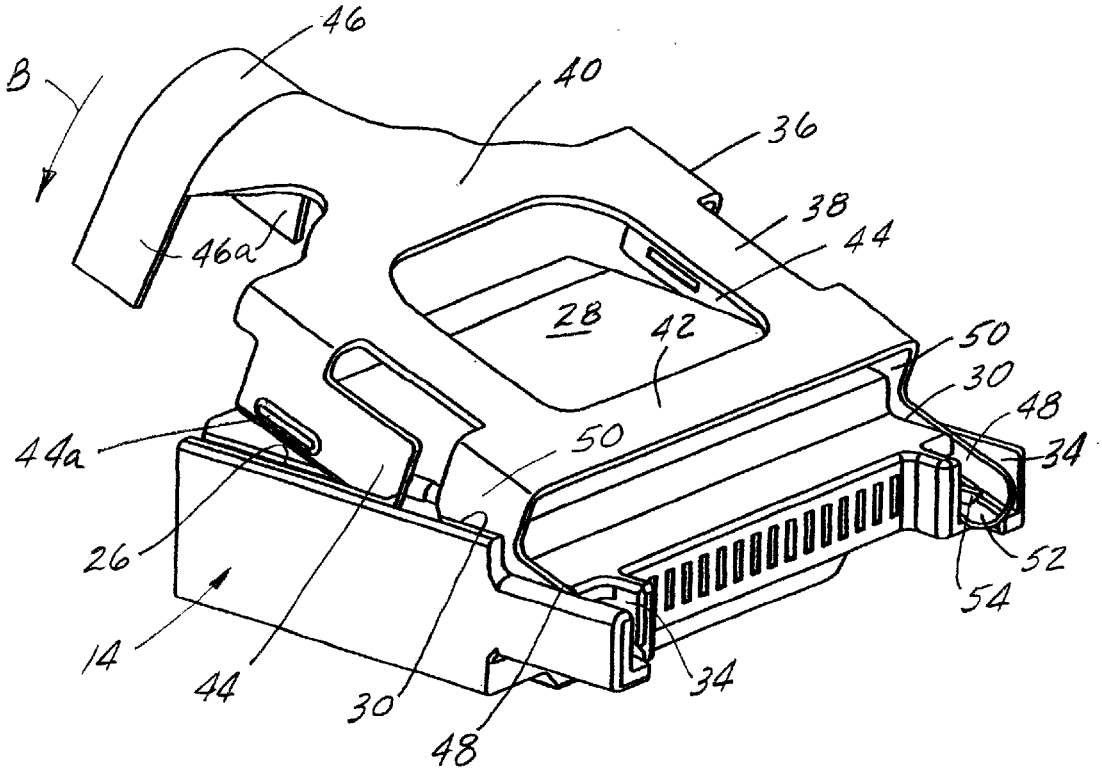
FIG. 4 is a perspective view showing the latching clip in the process of being assembled to the inner housing.

FIG. 4 shows latching clip 36 being assembled to inner housing 14. During assembly, latch plates 52 at the distal ends of latch arms 48 first are properly located within enlarged latching areas 32 of front channels 30. The latch clip then is pivoted downwardly in the direction of arrow "B" as locating flanges 50 first enter into front channels 30. Further pivoting movement of the latching clip causes mounting flanges 44 to be pressed into rear channels 26. Mounting flanges 44 are press-fit into rear channels 26 as interference ribs 44*a* of the mounting flanges create a solid securement of the mounting clip to the housing, while latch arms 48 and latch plates 52 are freely movable within front channels 30 and enlarged areas 32 of the front channels.

When latching clip 36 is completely mounted to inner housing 14 as seen in FIG. 2, two significant things occur. First, rear cross portion 40 is seated solidly relative to the inner housing while front cross portion 42 is raised above top surface 28. In this manner, front cross portion 42 acts as an integral actuating portion joining latch arms 48. In other words, front cross portion 42 can be depressed downwardly when the actuating button 16 (FIG. 1) of outer housing 12, is pushed to move latch arms 48 and latch plates 52 downwardly within the enlarged latching areas 32 of front channels 30 in order to unlatch the connector from the complementary mating connector described hereinafter. In essence, front cross portion 42 and latch arms 48 are vertically reciprocal about a fulcrum defined by rear cross portion 40.

Figure 5:
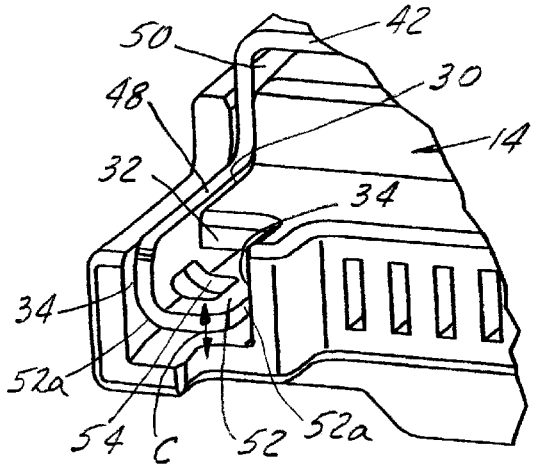
FIG. 5 is an enlarged perspective view of the latching area at the end of one of the latch arms of the assembly.
Figure 6:
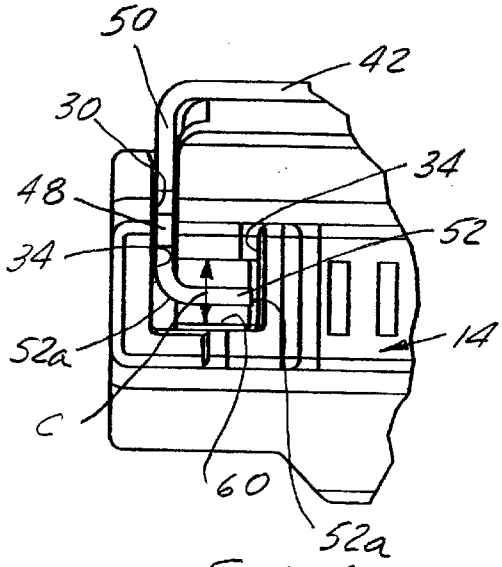
FIG. 6 is a front elevational view of the latching area of FIG. 5.

Secondly, and referring to FIGS. 5 and 6 in conjunction with FIG. 2, the side edges 52*a* of latch plates 52 are in relatively close proximity to side walls 34 of enlarged latching areas 32 at the front of channels 30. These side walls limit lateral movement of the latch plates in the planes of the latch plates. On the other hand, it can be seen best in FIG. 6 that latch plates 52 are raised above a bottom wall or floor 60 so that the latch plates are free to reciprocally move in the direction of double-headed arrow "C". Therefore, the latch plates can vertically reciprocate with latch arms 48 and the actuating portion provided by front cross portion 42, while the latch plates are confined against lateral movement generally perpendicular to double-headed arrow "C". It also can be seen in FIGS. 2, 5 and 6 that latch arms 48 and latch plates 52 are located substantially entirely within the bounds of front channels 30 and enlarged latching areas 32 of the front channels. This prevents the latch arms and latch plates from catching or snagging on extraneous objects during shipping and handling or during mating and unmating of the connector.

Figure 7:
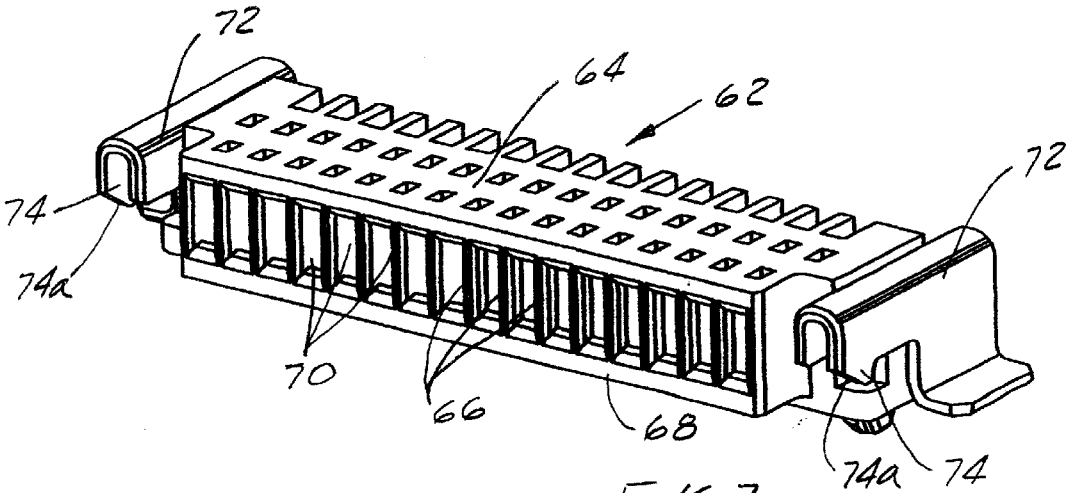
FIG. 7 is a perspective view of a complementary mating connector for mating with the connector of FIGS. 1–6.

FIG. 7 shows an example of a complementary mating connector, generally designated 62, for mating with connector 10. This depiction is for representation only, because a wide variety of mating connecting devices can be used with connector 10. With that understanding, mating connector 62 includes a non-conductive housing 64 defining a plurality of receptacles 66 at a forward mating face of the housing. A plurality of terminals 70 are mounted within the housing and are exposed within receptacles 66. When connector 10 is mated with complementary mating connector 62, terminal blades 24 (FIG. 2) are inserted into receptacles 66 and engage terminals 70. A pair of latch devices 72 are mounted to opposite ends of housing 64. Each latch device includes a latch hook 74 having a chamfered front edge 74*a*. When the connectors are mated, front edges 74*a* of latch hooks 74 engage the front edges of latch plates 52 (FIG. 2), biasing the latch plates and latch arms 48 downwardly until latch hooks 74 are in registry with latch apertures 54 in latch plates 52, whereupon the latch arms and latch plates snap back upwardly into latching engagement with latch hooks 74 of latch devices 72. In order to unmate the connectors, the actuating portion of latching clip 36 provided by front cross portion 42 is depressed downwardly by actuating button 16 to move latch plates 52 out of interengagement with latch hooks 74 of the mating connector. The mating connector, thereby, is free to be pulled away from connector 10.

Figure 8:
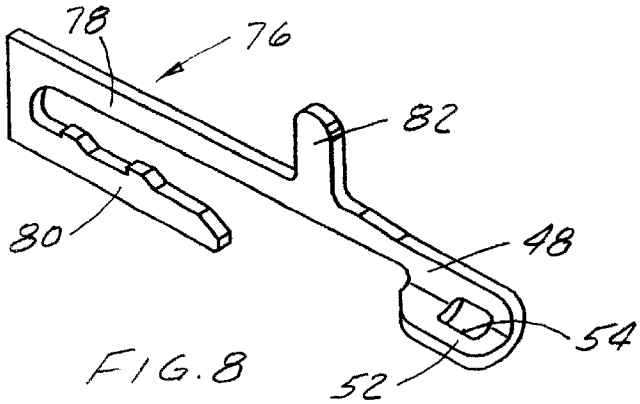
FIG. 8 is a perspective view of an alternate embodiment of a latch arm according to the invention.

FIG. 8 shows an alternate embodiment of the invention wherein each latch arm 48 and its integral latch plate 52 are formed on the front distal end of a separate latching device, generally designated 76. In other words, the one-piece latching clip 36 (FIG. 3) is replaced by two latching devices 76. Each latching device 76 includes a rearwardly projecting arm 78 coextensive with latch arm 48, along with a downwardly-depending mounting arm 80. Latching devices 76 are mounted to housing 14 similar to the mounting procedure described above in regard to latching clip 36 and FIG. 4, except that two latching devices 76 are mounted to housing 14 rather than the singular latching clip. Mounting arms 80 of latching devices 76 are press-fit and securely mounted within rear channels 26 of the housing, while latch arms 48 and latch plates 52 are free to move within front channels 30 and enlarged latching areas 32 of the front channels. Each latching device 76 has an upwardly projecting actuating tab 82 whereby both actuating tabs are engageable by actuating button 16 (FIG. 1) to move latch arms 48 and latch plates 52 together to unmate the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for mating with a complementary connecting device in a mating direction, comprising:

a non-conductive housing mounting a plurality of conductive terminals, the housing having a channel extending generally parallel to said mating direction, the channel having, at a forward mating end of the housing, opposite side walls and an opening; and a flexible latch arm having a free end located in said channel, the free end having a latch plate for latchingly engaging an appropriate latch of the complementary connecting device inserted into the opening of the channel, the latch plate being in a plane generally parallel to said mating direction, and the latch plate having side edges confined by said opposite side walls of the channel, whereby the flexible latch arm and latch plate can flex in a direction generally perpendicular to the plane of the latch plate, but the latch arm and latch plate are confined against movement in the plane of the latch plate;

wherein said latch arm is elongated and generally planar in a plane generally parallel to said mating direction and generally perpendicular to the plane of the latch plate.

2. The electrical connector of claim 1 wherein said latch arm and latch plate are independent of the housing and are fabricated of metal material.

3. The electrical connector of claim 1 wherein said latch plate has a latch aperture for latching engagement by the latch of the complementary connecting device.

4. The electrical connector of claim 1, including a pair of said latch arms and respective latch plates at opposite sides of the housing.

5. The electrical connector of claim 4 wherein said pair of latch arms and latch plates are located outside opposite ends of an elongated array of said terminals on the housing.

6. The electrical connector of claim 4 wherein said pair of latch arms and latch plates are integral components of a common metal latching clip.

7. The electrical connector of claim 6 wherein said latching clip includes an integral electrical cable clamping portion at a rear terminating end of the housing.

8. The electrical connector of claim 6 wherein said latching clip includes an integral actuating portion joining the pair of latch arms for moving the latch plates out of latching engagement with the latches of the complementary connecting device.

9. The electrical connector of claim 1 wherein said latch arm has an actuating portion projecting from the channel to facilitate moving the latch plate out of latching engagement with the latch of the complementary connecting device.

10. An electrical connector for mating with a complementary connecting device in a mating direction, comprising:

a non-conductive housing mounting a plurality of conductive terminals, the housing having a channel extending generally parallel to said mating direction, the channel having, at a forward mating end of the housing, opposite side walls and an opening; and a flexible metal latch arm independent of and mounted on the housing and having a free end located in said channel, the free end having a latch plate with a latch aperture for latchingly engaging an appropriate latch of the complementary connecting device inserted into the opening of the channel, the latch plate being in a plane generally parallel to said mating direction and having side edges confined by said opposite side walls of the channel, and the latch arm being elongated and generally planar in a plane generally parallel to the mating direction and generally perpendicular to the plane of the latch plate, whereby the flexible latch arm and latch plate can flex in a direction generally perpendicular to the plane of the latch plate, but the latch arm and latch plate are confined against movement in the plane of the latch plate.

11. The electrical connector of claim 10, including a pair of said latch arms and respective latch plates at opposite sides of the housing.

12. The electrical connector of claim 11 wherein said pair of latch arms and latch plates are located outside opposite ends of an elongated array of said terminals on the housing.

13. The electrical connector of claim 11 wherein said pair of latch arms and latch plates are integral components of a common metal latching clip.

14. The electrical connector of claim 13 wherein said latching clip includes an integral electrical cable clamping portion at a rear terminating end of the housing.

15. The electrical connector of claim 13 wherein said latching clip includes an integral actuating portion joining the pair of latch arms for moving the latch plates out of latching engagement with the latches of the complementary connecting device.

16. An electrical connector for mating with a complementary connecting device in a mating direction, comprising:

a non-conductive housing mounting a plurality of conductive terminals, the housing having a channel extending generally parallel to said mating direction with an opening to the channel at a forward mating end of the housing; and a flexible latch arm having a free end located in said channel, the latch arm having a latch portion near the free end thereof for latchingly engaging an appropriate latch of the complementary connecting device inserted into the opening of the channel, the latch arm and latch portion being located substantially entirely within the bounds of the channel;

including a pair of said latch arms at opposite sides of the housing;

wherein said pair of latch arms are integral components of a common metal latching clip.

17. The electrical connector of claim 16 wherein said latch arm and latch portion are independent of the housing and are fabricated of metal material.

18. The electrical connector of claim 16 wherein said latch arm has an actuating portion projecting from the channel to facilitate moving the latch portion out of latching engagement with the latch of the complementary connecting device.

19. The electrical connector of claim 17 wherein said pair of latch arms are located outside opposite ends of an elongated array of said terminals on the housing.

20. The electrical connector of claim 17 wherein said latching clip includes an integral electrical cable clamping portion at a rear terminating end of the housing.

21. The electrical connector of claim 17 wherein said latching clip includes an integral actuating portion joining the pair of latch arms for moving the latch portions out of latching engagement with the latches of the complementary connecting device.

22. The electrical connector of claim 16 wherein the latch portion of said latch arm comprises a planar latch plate having an aperture for latching engagement by the latch of the complementary connecting device.

* * * * *